US007470164B2

(12) United States Patent
Moyal

(10) Patent No.: US 7,470,164 B2
(45) Date of Patent: Dec. 30, 2008

(54) SWIM FIN WITH ADJUSTABLE WEB

(76) Inventor: Ronen M. Moyal, 2409 N. Evergreen Ave., Arlington Heights, IL (US) 60004

( * ) Notice: Subject to any disclaimer, the term of this patent is extended or adjusted under 35 U.S.C. 154(b) by 0 days.

(21) Appl. No.: 11/334,577

(22) Filed: Jan. 18, 2006

(65) Prior Publication Data

US 2007/0167094 A1 Jul. 19, 2007

(51) Int. Cl.
*A63B 31/08* (2006.01)

(52) U.S. Cl. ..... 441/64

(58) Field of Classification Search ..... 441/61–64; D21/806

See application file for complete search history.

(56) References Cited

U.S. PATENT DOCUMENTS

| | | | | |
|---|---|---|---|---|
| 4,752,259 | A * | 6/1988 | Tackett et al. | 441/64 |
| 4,981,454 | A * | 1/1991 | Klein | 441/62 |
| 5,632,662 | A * | 5/1997 | Cadorette | 441/63 |
| 6,129,601 | A * | 10/2000 | Aucoin | 441/64 |
| 6,346,021 | B1 | 2/2002 | Masse | |
| 6,568,975 | B1 | 5/2003 | Perry et al. | |
| 6,814,640 | B1 | 11/2004 | Houck | |
| 6,893,307 | B1 | 5/2005 | Melius | |

* cited by examiner

*Primary Examiner*—Ed Swinehart

(57) ABSTRACT

A swim fin having a web portion pivotably attached to a shoe portion that Is rotatable to a first position substantially perpendicular to the shoe portion for walking and a second position in a plane with the shoe portion for propulsion in water.

3 Claims, 13 Drawing Sheets

SWIM FIN WITH ADJUSTABLE WEB

FIELD OF THE INVENTION

This invention relates to swim fins that have an adjustable web portion moveable into a first and second position. More particularly, the invention relates to a swim fins wherein the fins are adjusted so the user can walk with the fins in the first position and swim in water with the fins in the second position.

BACKGROUND OF THE INVENTION

Traditionally, swim fins are adapted to provide propulsion of the user in water. When wearing swim fins the user typically has difficulty walking on hard surfaces, land, the beach or a boat because of the size, shape and flexibility of the swim fin.

The prior art addresses issues relating to propulsion in water as seen, for example, in U.S. Pat. No. 6,814,640. The patent describes a swim fin with a segmented web portion with an array of spaced apart slots oriented along the web portion. The slots contain support members hingedly supported thereon to provide movement in the water thereby propelling the user. U.S. Pat. No. 6,893,307 describes an ergonomic swim fin with channeling scoops on either side of a foot pocket and a flexible blade web portion. At the tip of the web portion a wing shaped tail fin is pivotally attached to aid in the propulsion of the user.

It is desired to have a swim fin that has a foot portion and a pivotally mounted web portion for movement into a first position for walking and a second position for propulsion in water.

SUMMARY OF THE INVENTION

The swim fin of the present invention advantageously provides a swim fin comprising a foot portion and a web portion. The web portion is pivotally attached to the foot portion. When the web portion is placed in a first position, for walking, the web portion is substantially perpendicular to the foot portion and provides for facile movement on land and hard surfaces. With the web portion in the second position and extending outwardly from the foot portion, the swim fin is capable of propelling the user in water.

It is therefore an object of the invention to provide an improved swim fin device having an adjustable web portion.

It is also an object of the present invention to provide a swim fin with an adjustable web portion that pivots from the sides of a shoe.

It is also another object of the present invention to provide a swim fin device that allows the user to place the web portion in one position for walking and a second position for propulsion while the user is swimming in water.

These and other objects, features and advantages will be better understood from the following description of the preferred embodiments of this invention, when taken in conjunction with the following drawings.

DETAILED DESCRIPTION OF A PREFERRED EMBODIMENT

Figure 1:
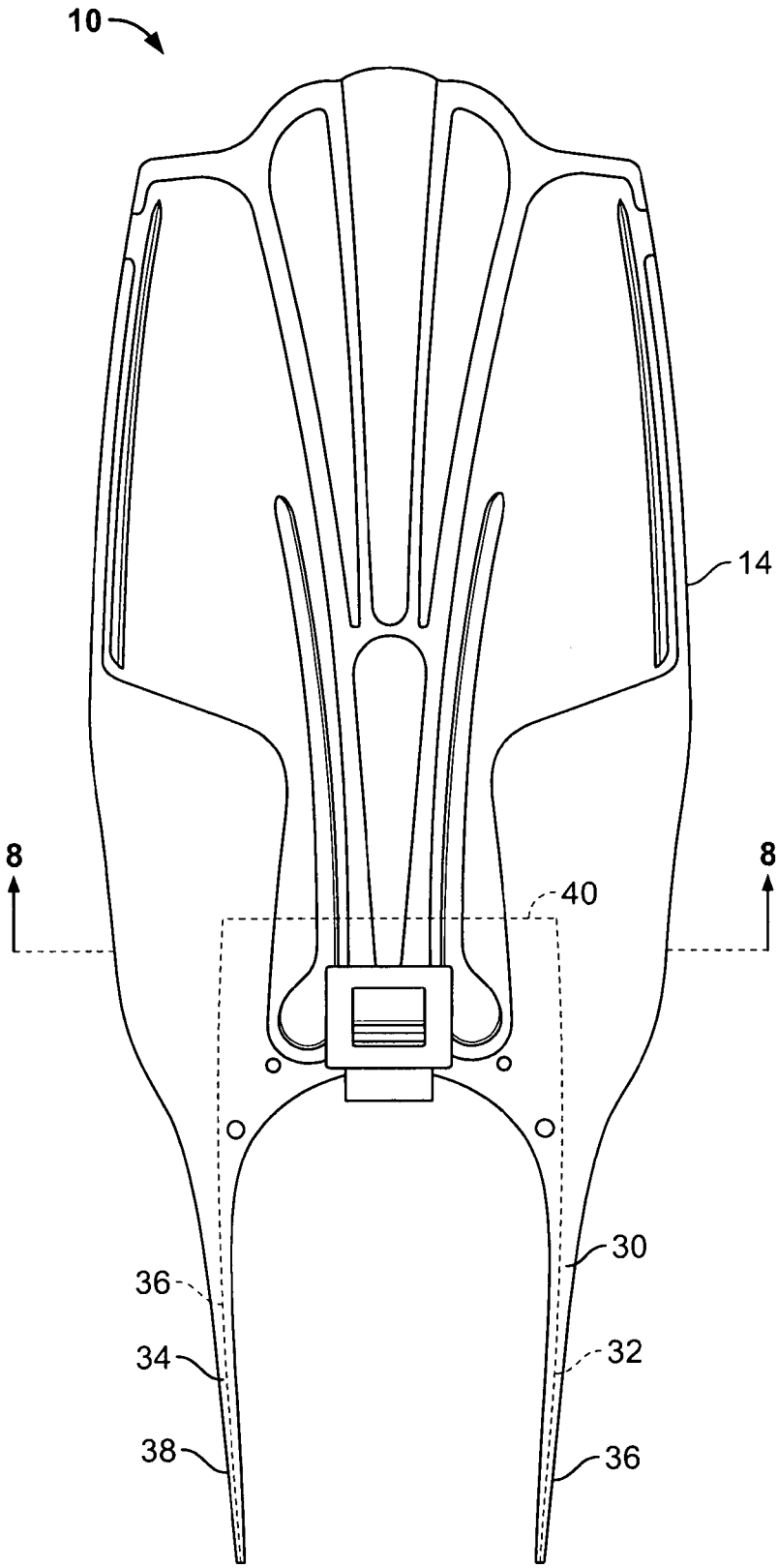
FIG. 1 is a top view of one embodiment of a swim fin of the present invention with dotted lines showing resilient means embedded in the web portion of the swim fin.
Figure 2:
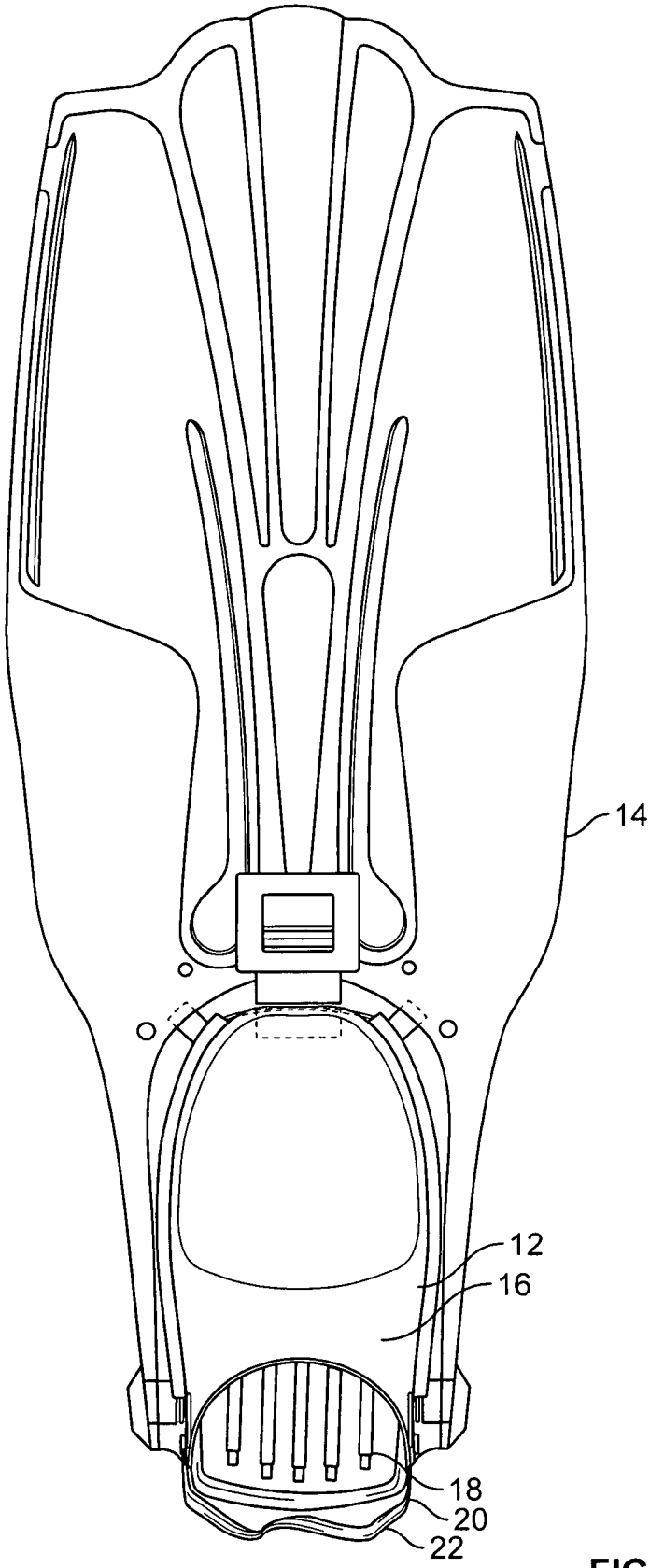
FIG. 2 is a top view of an embodiment of the present invention illustrating a foot portion and web portion engaged for use by a swimmer in water for propulsion.
Figure 3:
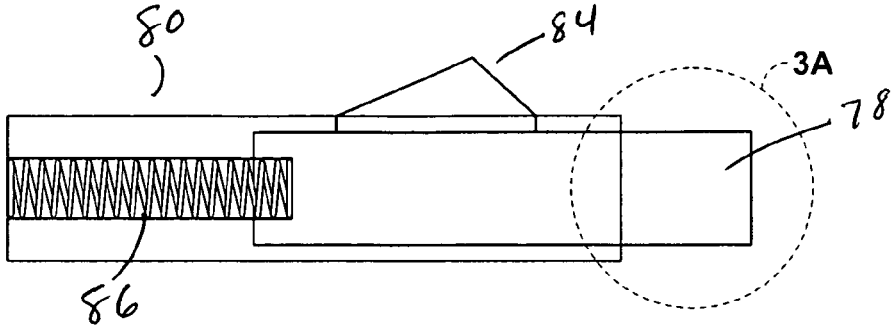
FIG. 3 is a side elevational view of a locking mechanism for securing a resilient means attached to the foot portion for engaging the web portion in a second position for swimming by the user.
Figure 3A:
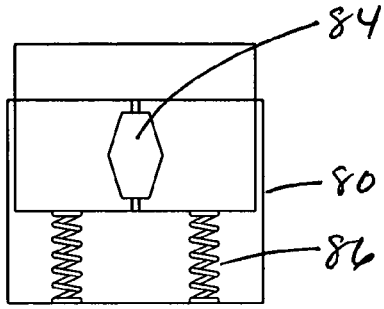
FIG. 3A is a top view of a locking mechanism.
Figure 4:
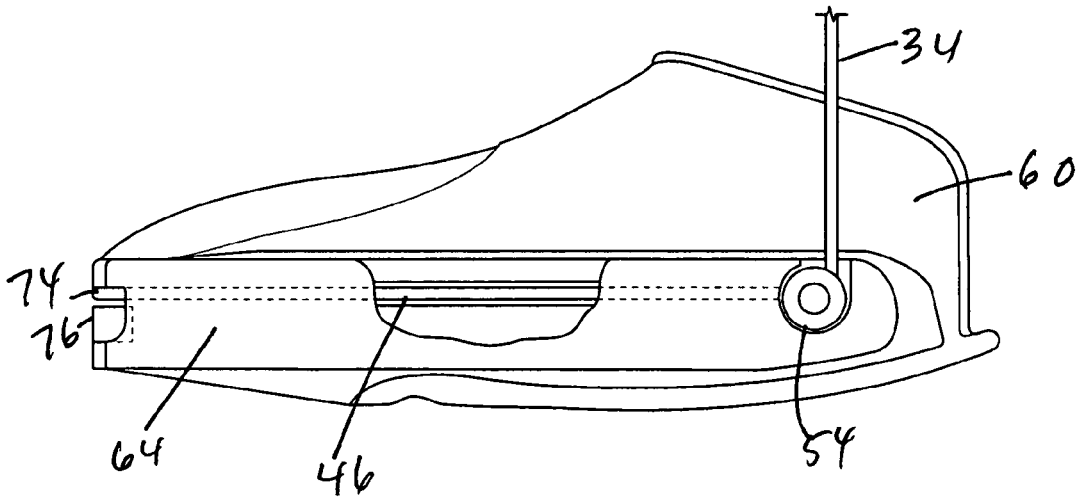
FIG. 4 is a side view of the foot portion of the present invention.

The present invention will now be described more fully hereinafter with reference to the accompanying drawings, in which various embodiments of the invention are shown. Unless otherwise defined, terms used herein have the same meaning as commonly understood by one with ordinary skill in the art to which the invention pertains. Although methods and materials similar or equivalent to those described herein can be used in the practice or testing of the present invention, suitable methods are described below. In addition, materials and methods given are illustrative in nature only and not intended to be limiting. Accordingly, this invention may be embodied in different forms and should not be construed as limited to the illustrated embodiments set forth herein. The illustrated embodiments are provided solely for exemplary purposes so that this disclosure will be thorough and complete. Other features and advantages of the invention will apparent from the following detailed description, and from the claims.

FIGS. 1-16 illustrate embodiments of a swim fin 10 comprising a foot portion 12 and a web portion 14. The foot portion 12 has shoe 16 for receiving the foot of the user with raised implements 18 on the floor of the shoe for supporting the user's foot and for providing a grip for facilitating movement. The term "shoe" is used herein with reference to the foot portion 12 is intended to include any structural arrangement which permits the user to secure the swim fin to the foot. For example, a "shoe" in the foot portion may be a compartment of sufficient size to therein receive the forward portion of a user's foot, and having connected thereto securing means 20 around the heel of the user's foot. This and other arrangements as understood by skilled workers in the art for securing the swim fin in contact with the foot are intended to be included within the meaning of the term "shoe" as employed herein and recited in the claims.

The heel of the user's foot is held in place by securing means 20. Securing means 20 can be any arrangement or device for securing the user's foot in shoe 16. It may comprise material that encloses the heel and foot or wraps around the back of the user's heel. Preferably, the securing means is an adjustable strap 22. However, the use of the adjustable strap is not intended to be unduly limitative.

Figure 5:
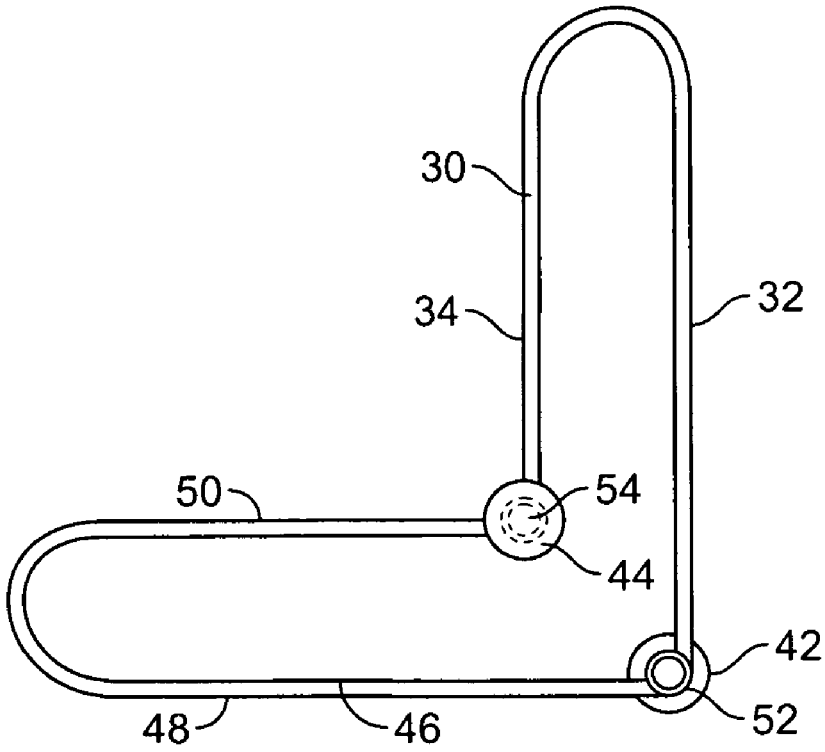
FIG. 5 is a perspective view of the resilient means of an embodiment of this invention.
Figure 8:
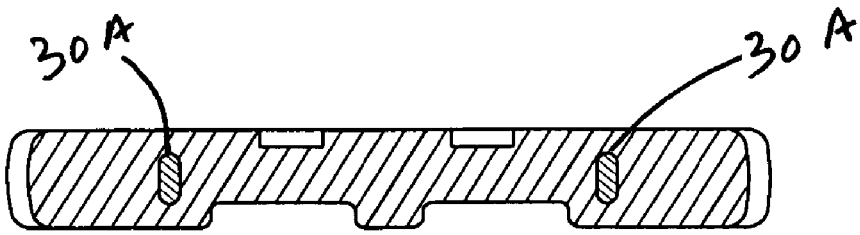
FIG. 8 is a cross section of the web portion at the dotted lines 8-8 in FIG. 1.

The web portion 14 of swim fin 10 includes a resilient upper member 30 embedded in the web portion 14 as shown in dotted lines in FIG. 1. Resilient member 30 has extensions 32 and 34 which pass through arms 36 and 38 of web portion 14. Engaging extensions 32 and 34 is a lateral arm 40 which is a cross member of resilient member 30. The lateral arm 40 is exemplary of any piece known in the art for engaging extensions 32 and 34. It may be rounded, semi-circular, or have square or ninety degree corners. The upper member 30 is embedded in web portion 14 as well as extensions 32 and 34 in arms 36 and 38, respectively. Indeed, the resilient member 30 is preferably constructed of one piece of resilient material as shown in FIG. 5. Lateral member 40 may be a portion of resilient member 30, for it is not required to be a separate piece. In addition, resilient member 30 is not required to have lateral member 40 if separate legs or members are sufficiently functional for the purpose of supporting the web portion 14 as shown in an alternate embodiment, for example, as in FIG. 16. The resilient material includes upper resilient member 30 which engages general pivot members 42 and 44 which secure lower resilient member 46 to the shoe 16 and to upper resilient member 30. The lower resilient member 46 has extensions 48 and 50. The resilient members 30 and 46 are made from a flexible spring-like material such as metal, for example, flexible steel, or plastic. The material must be flexible for the upper resilient member must pivot about ninety degrees to be operational. The lower and upper resilient members meet at joints 52 and 54 with pivot members 42 and 44 allowing the resilient members 46 (lower) and 30 (upper) to pivot. The resilient member is preferably one continuous piece of the spring-like material. When the spring-like material is relaxed, the web 14 is in the first position for walking by the user. When the spring-like material is in a folded or compressed state, the web 14 is locked to the shoe 16 in a second position for swimming by the user. It may preferably be wrapped around joints or bolts 52 and 54, included in pivot members 42 and 44. Upper resilient member 30 passes through channel 30A in web portion 14, as shown in FIG. 8. Lower resilient member 46 passes through channel 46A in foot portion 12.

As shown in FIGS. 4, 7, 9A and 9B, lower resilient member 46 is embedded in a first side 60 and second side 62 of shoe 16. Lateral covers 64 and 66 protect the lower resilient member 46 as it extends along the perimeter of the shoe up to the toe portion 68. Lower resilient member 46 is also exposed between toe placements 70 and 72 so that the exposed portion 74 of the lower resilient member 46 is available for further uses and applications. The lower resilient member 46 extends through channel 46A under lateral cover 64 to joint 52.

Figure 7:
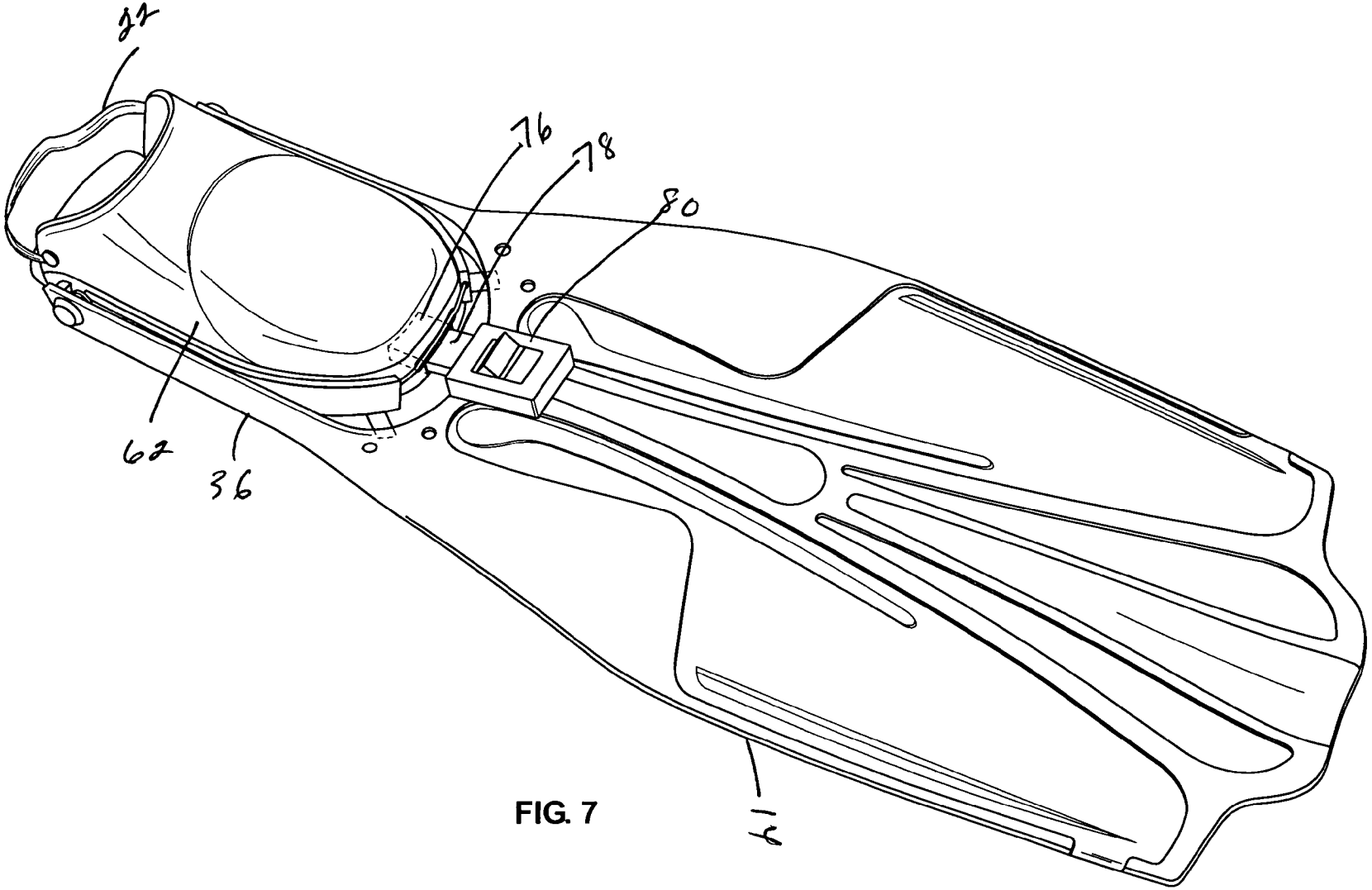
FIG. 7 is a perspective view of an embodiment of the present invention wherein the foot portion and web portion are engaged in a second position for allowing swimming by the user in water.
Figure 9A:
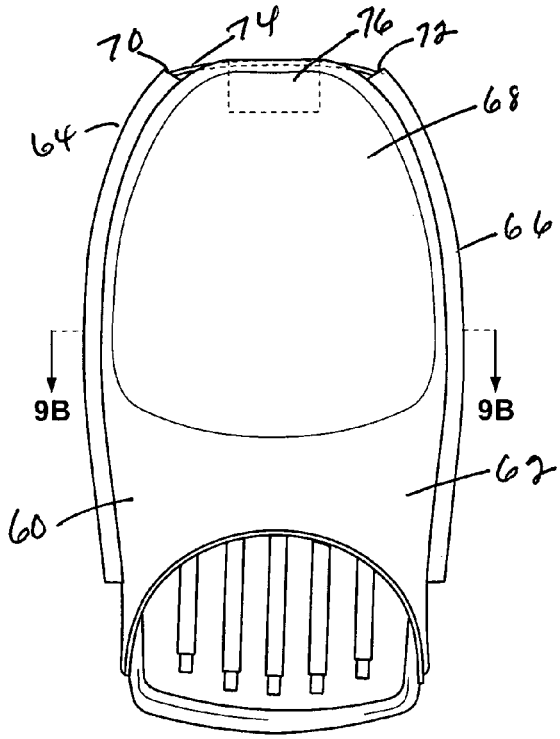
FIG. 9A is a top view of an embodiment of the present invention showing a foot portion.
Figure 9B:
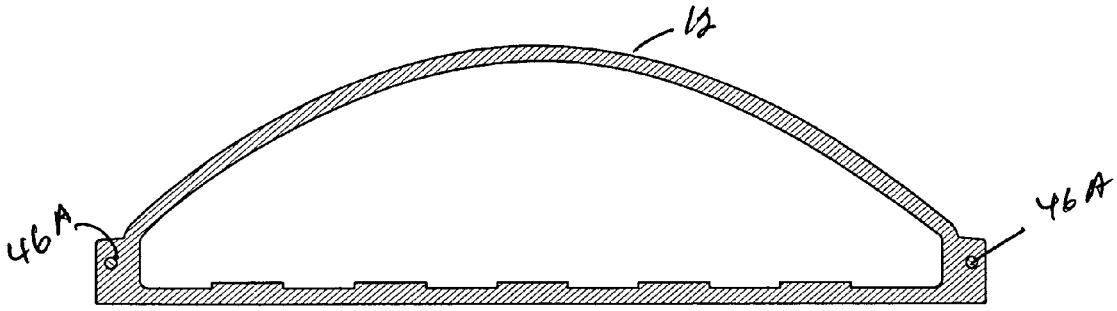
FIG. 9B is a cross section taken at lines 9B of FIG. 9A.
Figure 10:
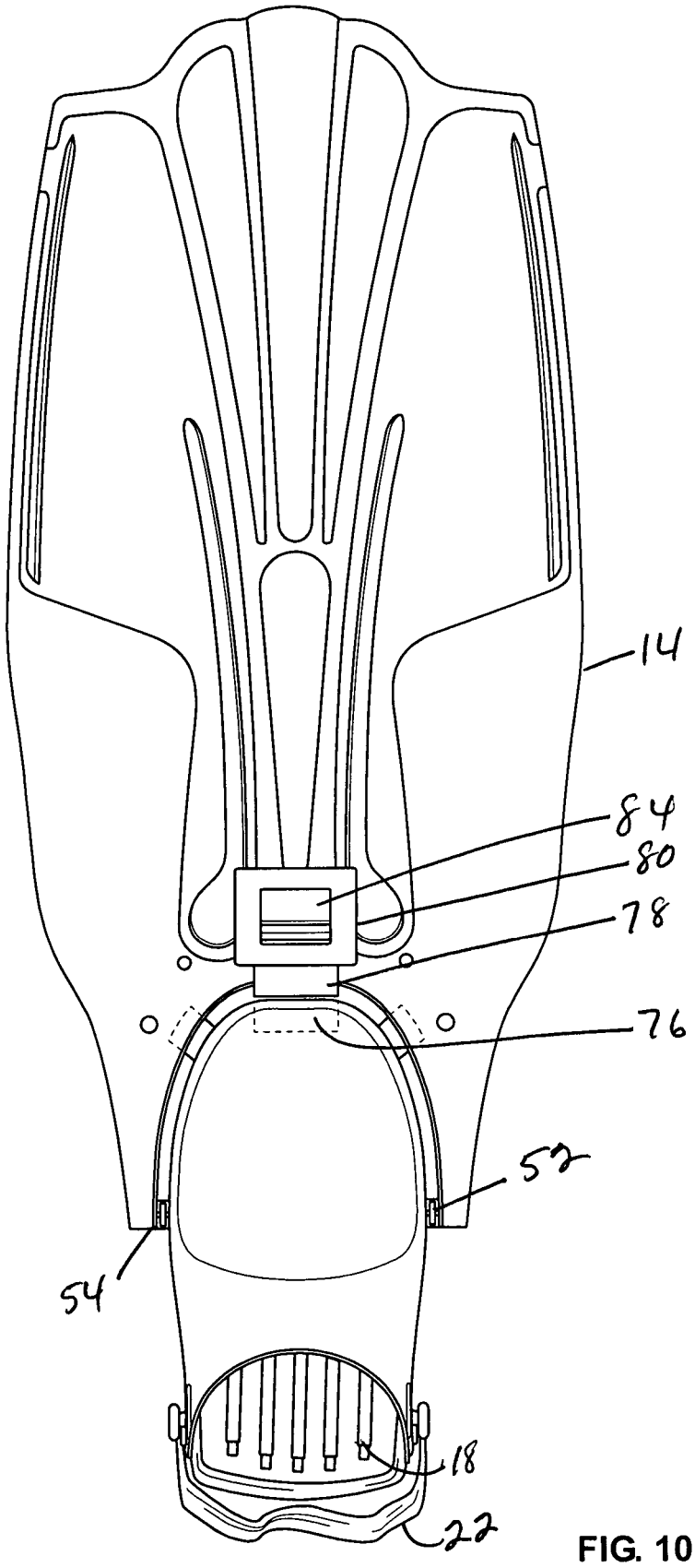
FIG. 10 is a top view of an embodiment of the present invention showing pivoting means located on either side of the foot portion mid-way between the front and rear of the foot portion.

The exposed portion 74 may be rounded or have corners. It generally follows the curvature of the toe 68 of the shoe 16. The toe portion also contains aperture 76 for receiving the exposed portion 74 and tongue 78 of locking mechanism 80. The locking mechanism assembly 82 is attached to the top of web portion 14 adjacent aperture 76. When the web is rotated on pivot members 42 and 44 and joints 52 and 54 to the second position for swimming, aperture 76 is aligned with tongue 78 of the locking mechanism. The pivot members may be placed on each side of the shoe. The location of the pivot members on the side of the shoe 16 may be in any location allowing for the pivoting or rotation of the web 14 from a first position to a second position. Slide 84 is pushed forward so tongue 78 enters aperture 76 engaging lower resilient means 48 against the top of the aperture. Slide 84 can be activated by springs 86 or a similar mechanism. As shown in FIG. 7, the swim fin is locked in the second position for swimming use. As added support for the web portion 14, platform 88 extends forward from the toe portion 68. The platform supports the web portion 14 when the user moves the swim fin in the swimming motion.

Figure 6:
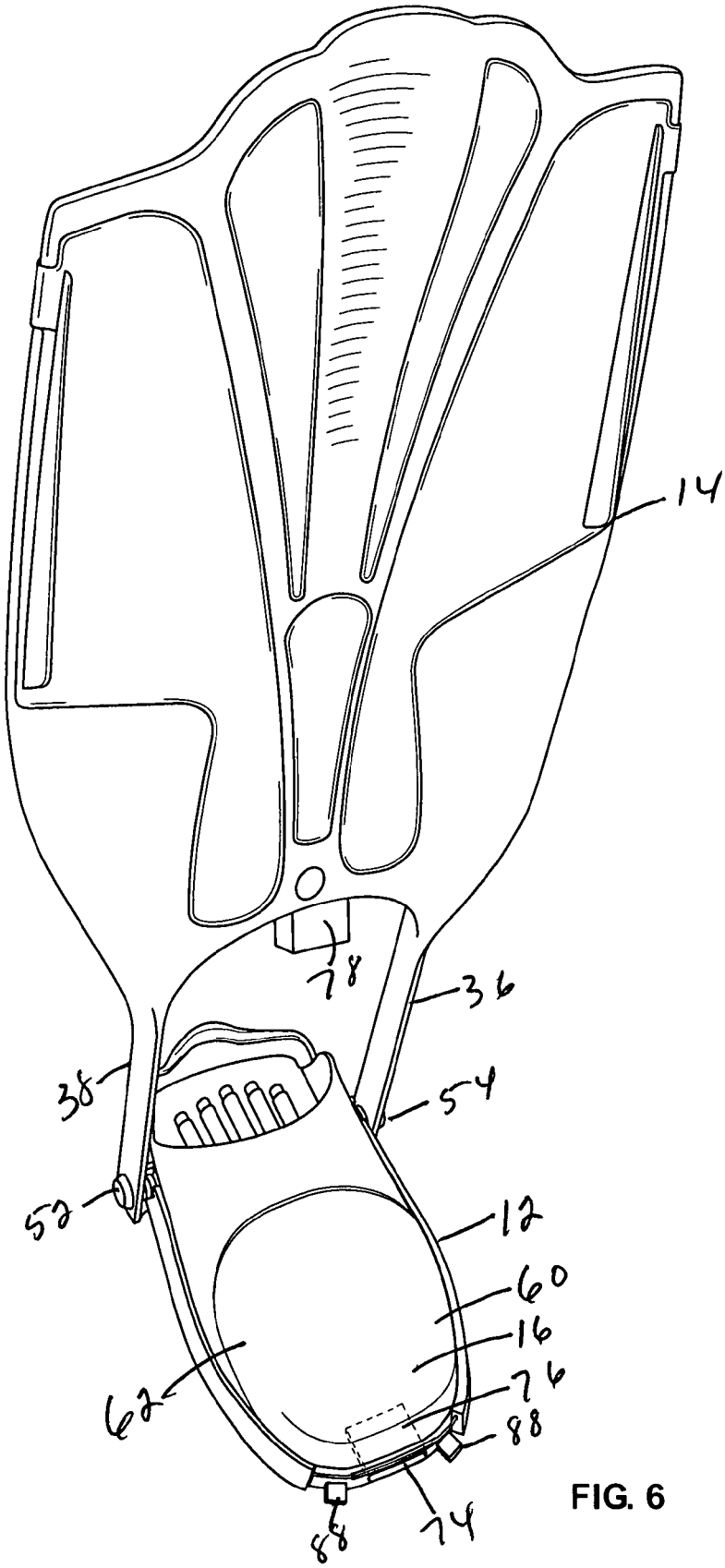
FIG. 6 is a perspective view of an embodiment of the present invention wherein the web portion is pivotally attached to the foot portion in a first position perpendicular to the foot portion thereof allowing walking by the user while wearing the swim fin.

FIG. 6 shows the web portion 14 in the first position, wherein the web portion is substantially perpendicular to the foot portion 12. The flexibility of the upper resilient member 30 and the action of the pivot 54 allows the upper resilient member 30 to be placed in a relaxed position when the web 14 is in the first position substantially perpendicular to foot portion 12. Force must be used to rotate the web portion 14 via the pivot means 42 and 44 and joints 52 and 54, wherein the resilient member engages joints 52 and 54 to move it into the second position for swimming. A locking mechanism 80, when engaged, prohibits the upper resilient means 30 from rotating into its rest position or first position.

Figure 11:
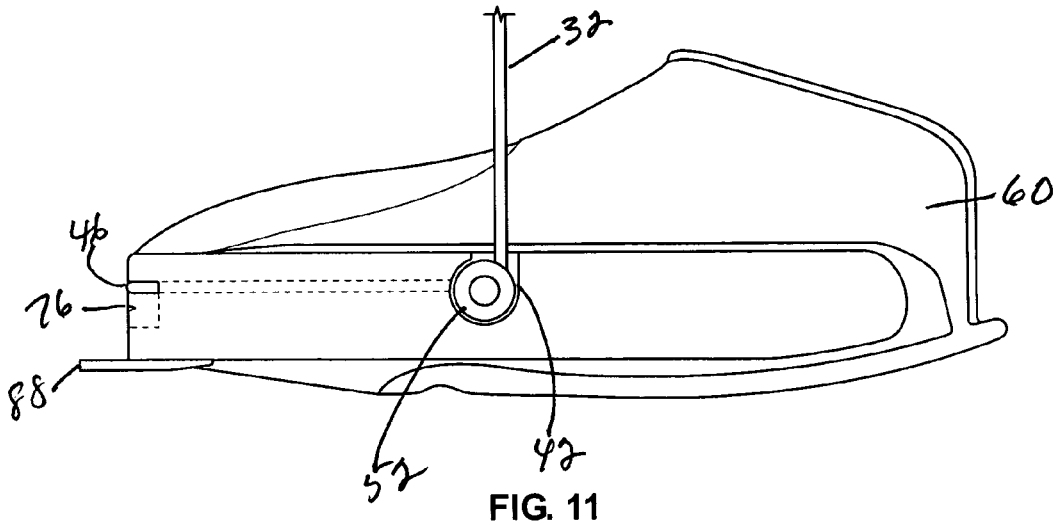
FIG. 11 is a side view of a foot portion of one embodiment of the present invention showing a pivoting means and flexible means located on the side of the foot portion mid-way between the front and rear of the foot portion with dotted lines showing flexible means of the side of the shoe.

An alternate embodiment is shown in FIG. 11 wherein joint 52 and pivot 54 are located at a midway position on the first and second sides 60 and 62 of the shoe 16. The position of the joint and pivot may allow for facile movement or rotation of the web portion 14.

Figure 12:
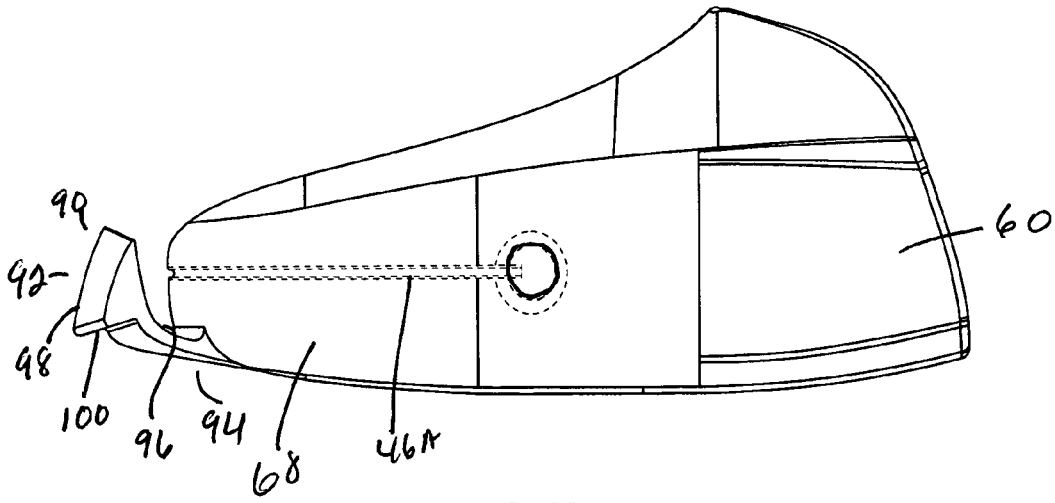
FIG. 12 is a side view of an embodiment of the present invention having a foot portion with an enclosed heel, dotted lines showing pivot and a channel for flexible means within the side of the shoe and an alternative locking mechanism for engaging the web portion.

An alternate locking mechanism 90 is shown in FIGS. 12-16. The alternative locking mechanism is attached to the toe 68 on its lower front side for receiving the inside periphery 14A of web 14. In FIG. 12, locking mechanism 90 is designed as a lip 92 and is rounded to match the contour of toe 68 with a base 94 attached or molded from the same material as shoe 16, which may be any conventional material, for example, rubber or plastic. The concave inside wall 96 of the lip 92 runs along the outside of toe 68. The outside wall 98 has a smooth surface and is curved to match the contour of the inside wall and toe. Shoulder 100 is formed in the lower side of the outside wall for engaging inner periphery 14A and top of web

Figure 13:
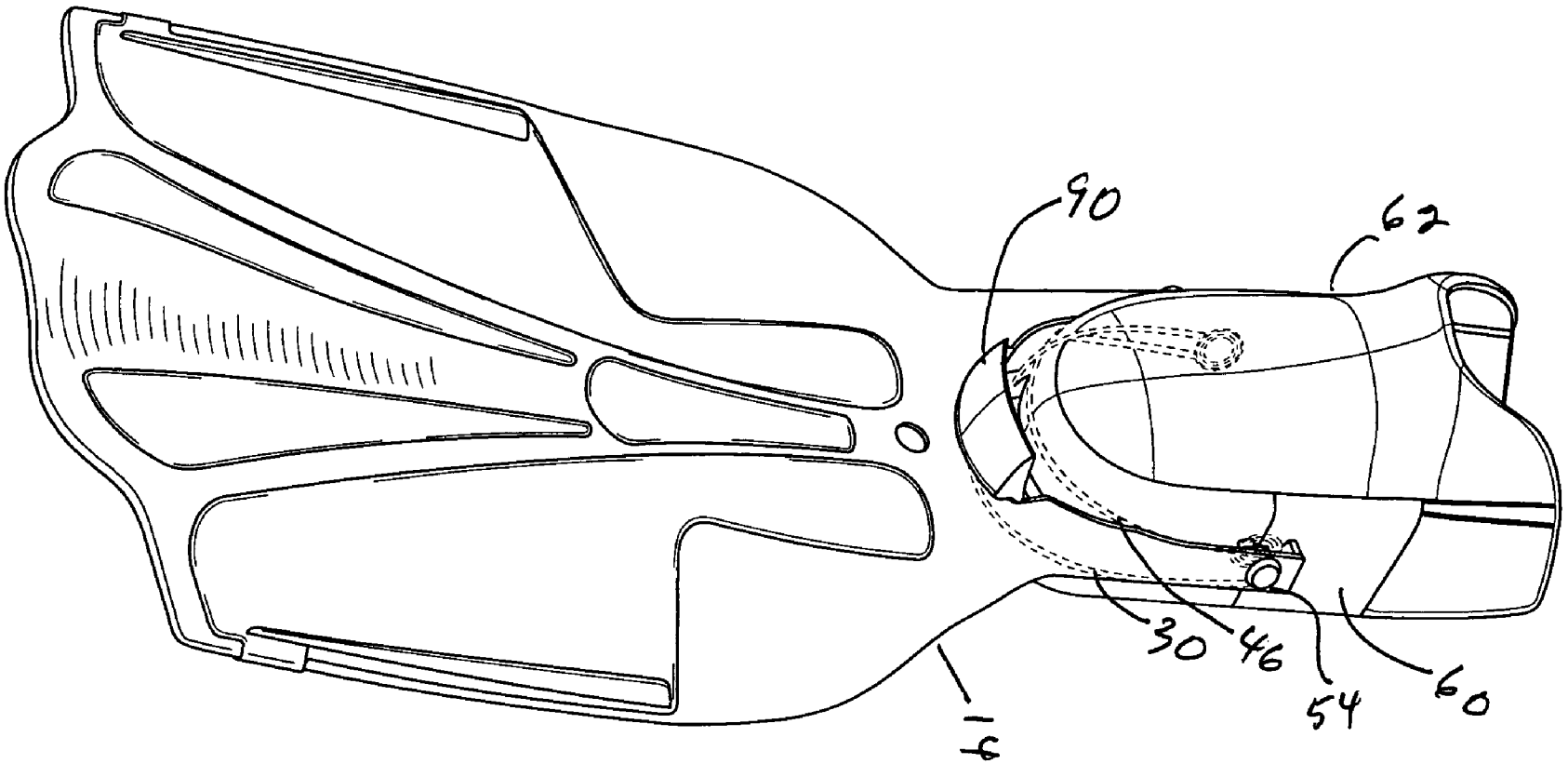
FIG. 13 is a perspective view of an embodiment of the present invention showing the fin in a second position for swimming by the user with an alternative locking mechanism securing the fin to the shoe.
Figure 14:
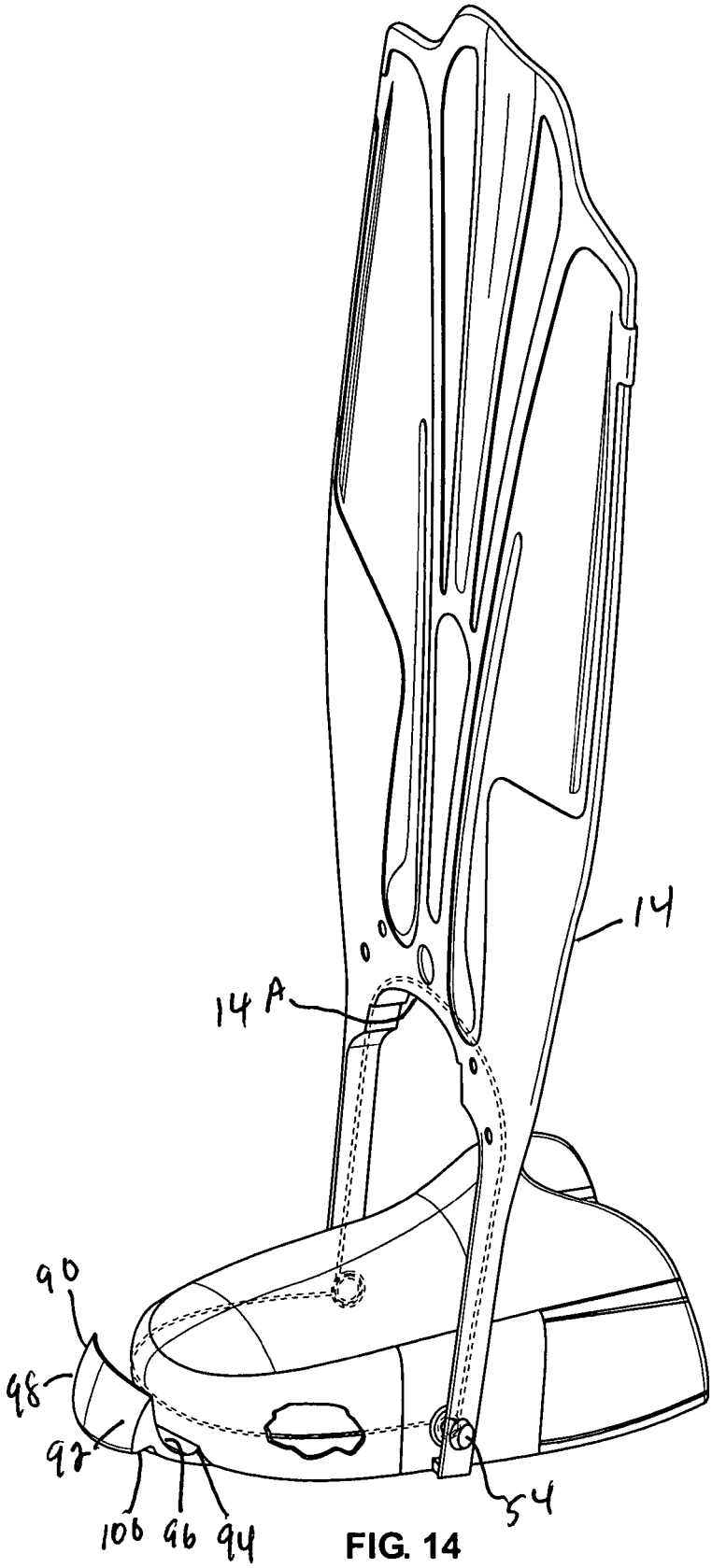
FIG. 14 is a perspective view of an embodiment of the present invention showing an alternative locking mechanism wherein the web is pivotally attached to the foot portion in a first position perpendicular to the foot portion allowing walking by the user while wearing the fin.

14, when the web is rotated to the second position for swimming as shown in FIGS. 13 and 14. Locking mechanism 90 may be made from the same material as shoe 16 or may be constructed of different conventional materials and attached to the shoe. Lip 92 is sufficiently flexible to allow web 14 to slide over the outside wall for fitting the inside periphery 14A of the web under shoulder 100. The web has an outside perimeter defining the outside edge of the fin 14 and the inside periphery 14A which is the inside edge of the fin contoured to the forward portion of the shoe 16. In this embodiment, a locking mechanism on web 14 is unnecessary as well as aperture 76 in shoe 16. While any locking mechanism may be utilized in the invention so as to secure web 14 in a first position for swimming may be utilized, the previously described embodiments of locking mechanisms are preferred.

Figure 15:
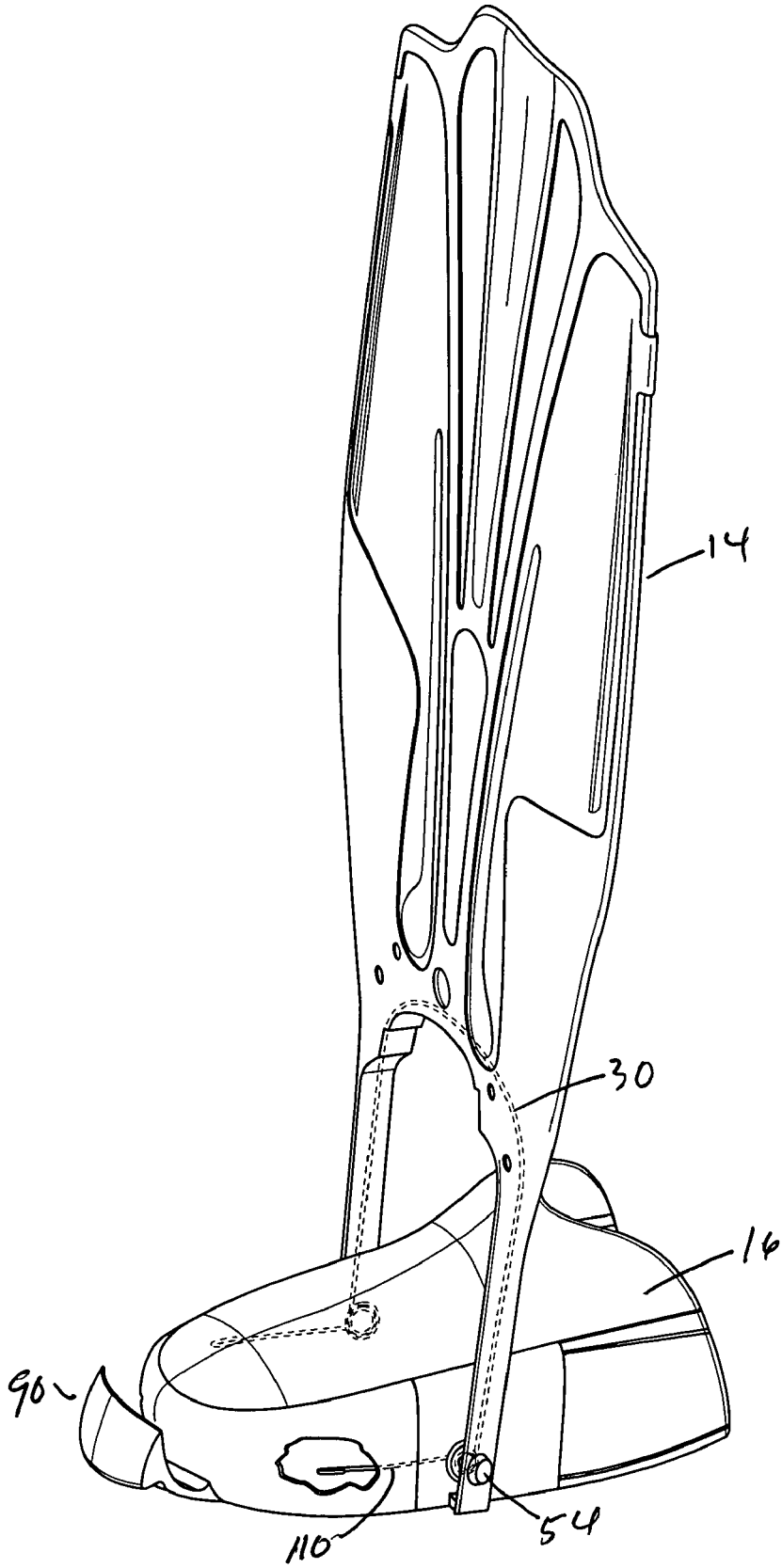
FIG. 15 is a perspective view of an embodiment of the present invention showing a shortened flexible means in the shoe and an alternative locking mechanism wherein the web is pivotally attached to the foot portion in a first position perpendicular to the foot portion allowing walking by the user.

In FIG. 15 a shortened lower resilient member 110 is shown as being within first side of shoe 60. The shortened resilient member readily functions when alternative locking means 90 is utilized.

Figure 16:
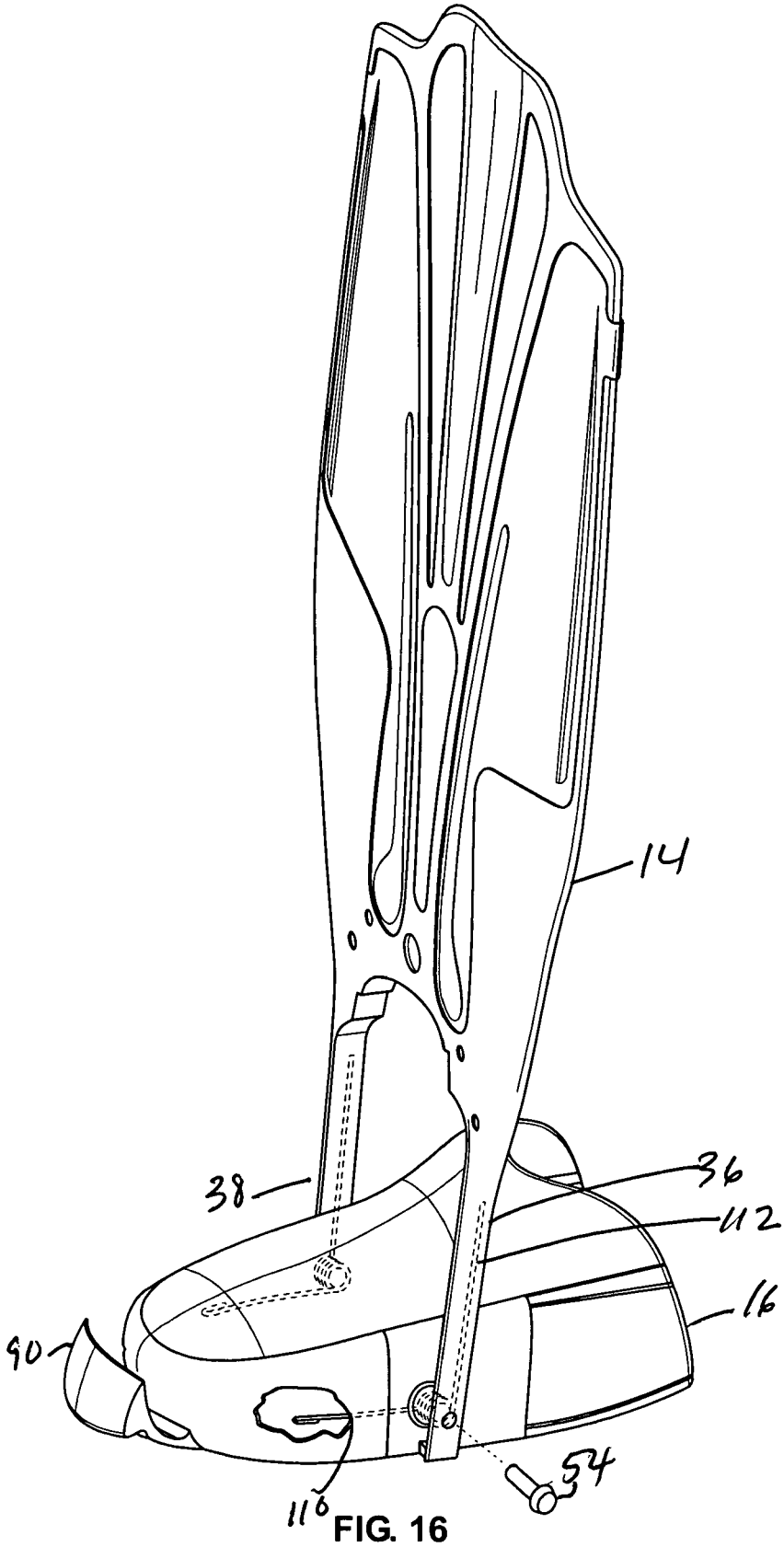
FIG. 16 is a perspective view of an embodiment of the present invention showing shortened flexible means in the shoe and web and an alternative locking mechanism wherein the web is pivotally attached to the foot in a first position allowing walking by the user.

FIG. 16 shows a shortened upper resilient member 112 extending into arms 36 and 38 of web portion 14. The shortened resilient members 110 and 112 are replaceable and can be easily removed from web portion 14 and shoe 16. They can be easily replaced if necessary by removing joint 52 and inserting the members in respective channels in arms 36 and 38, channels 30A and 46A and shoe 16.

In operation, the user's foot is placed in shoe 16, and the conventional securing means 20 or strap 22 are utilized for holding the foot in the shoe. For walking on hard surfaces, the web 14 is placed into the first position wherein the web portion is substantially perpendicular to the shoe. The web is merely rotated to this position or it may rotate into the first position by the action of the resilient member, preferably a one piece flexible spring having an upper resilient member placed in web 14 and a lower resilient member 46 placed in shoe 16. Preferably, the resilient member is secured around joints 52 and 54 to pivot web 14 from a first position for walking and a second position for swimming. For placement into the second position, web 14 is rotated to toe 68 of shoe 16 where it is secured by a locking mechanism. The fin is then in the second position for propelling the user in water.

Typical embodiments have been described in the drawings and specification. Specific terms have been used; however, the terms are used in a descriptive sense only and are not intended to be limitative. The invention has been described in considerable detail with specific reference to the illustrated embodiments. It will be apparent, however, that various modifications and changes can be made within the spirit and scope of the invention as described in the foregoing specification and as defined in the appended claims.

What is claimed is:

1. A swim fin comprising:

a foot portion for holding the foot of the user with a toe extending forwardly on the foot portion, the foot portion having first and second sides, with a channel running along the sides of the foot portion for holding a lower resilient member, an aperture on the toe of the foot portion allowing the lower resilient member to be exposed in said aperture;

a web portion connected to the foot portion by pivoting means and having channels for holding an upper resilient member and a locking mechanism for engaging the lower resilient member in the aperture on the toe of the foot portion.

2. The swim fin of claim 1, wherein the locking mechanism includes a locking tongue for slideably engaging in the aperture of the toe and an exposed lower resilient member to hold the web in a position for swimming by the user.

3. The swim fin of claim 1, wherein the locking tongue of the locking mechanism is not engaged into the aperture of the toe of the foot portion, thereby allowing the pivot means and upper resilient means to rotate the web in a position for walking by the user.

* * * * *